US009962713B2

(12) United States Patent
Roux

(10) Patent No.: US 9,962,713 B2
(45) Date of Patent: May 8, 2018

(54) ELECTROSTATIC COLLECTOR

(71) Applicant: COMMISSARIAT A L'ENERGIE ATOMIQUE ET AUX ENERGIES ALTERNATIVES, Paris (FR)

(72) Inventor: Jean-Maxime Roux, Grenoble (FR)

(73) Assignee: Commissariat à l'énergie atomique et aux énergies alternatives, Paris (FR)

( * ) Notice: Subject to any disclaimer, the term of this patent is extended or adjusted under 35 U.S.C. 154(b) by 173 days.

(21) Appl. No.: 15/021,594

(22) PCT Filed: Sep. 12, 2014

(86) PCT No.: PCT/EP2014/069476
§ 371 (c)(1),
(2) Date: Mar. 11, 2016

(87) PCT Pub. No.: WO2015/036528
PCT Pub. Date: Mar. 19, 2015

(65) Prior Publication Data

US 2016/0221004 A1 Aug. 4, 2016

(30) Foreign Application Priority Data

Sep. 13, 2013 (FR) ..... 13 58858

(51) Int. Cl.
*B03C 3/86* (2006.01)
*B03C 3/49* (2006.01)
*B03C 3/41* (2006.01)

(52) U.S. Cl.
CPC ..... *B03C 3/86* (2013.01); *B03C 3/41* (2013.01); *B03C 3/49* (2013.01); *B03C 2201/28* (2013.01)

(58) Field of Classification Search
CPC combination set(s) only.
See application file for complete search history.

(56) References Cited

U.S. PATENT DOCUMENTS 4,514,780 A * 4/1985 Brussee ..... B03C 3/86 361/226
5,066,313 A 11/1991 Mallory
(Continued)

FOREIGN PATENT DOCUMENTS

GB 811171 A * 4/1959 ..... B03C 3/49
WO 00 00291 1/2000
(Continued)

OTHER PUBLICATIONS

Jane H. Davidson, et al., "Chemical Vapor Deposition in the Corona Discharge of Electrostatic Air Cleaners", Aerosol Science and Technology, vol. 29, No. 2, Aug. 1998, pp. 102-110.
(Continued)

*Primary Examiner* — T. Bennett McKenzie
*Assistant Examiner* — Sonji Turner
(74) *Attorney, Agent, or Firm* — Oblon, McClelland, Maier & Neustadt, L.L.P.

(57) ABSTRACT

An electrostatic collector is provided, including a collection chamber, delimited by a tubular wall, and a support holding an electrode in position in the collection chamber and for removing it from the collection chamber, the support including a guide, passing transversally through the collection chamber, the first and second ends of which are fixed to the wall, the guide including a through opening configured to hold the electrode; a first attachment element, including at least one electrically conducting part, that will extend at least partly in the guide, from the first end towards the opening; and a second attachment element, including at least one electrically insulating part, that can move in translation in the guide from the second end towards the opening and from the opening towards the second end.

13 Claims, 4 Drawing Sheets

(56) References Cited

U.S. PATENT DOCUMENTS

| | | | | |
|---|---|---|---|---|
| 6,348,103 | B1 * | 2/2002 | Ahlborn | B03C 3/743 134/6 |
| 6,365,112 | B1 * | 4/2002 | Babko-Malyi | B01D 53/323 204/164 |
| 6,585,803 | B1 | 7/2003 | Chang et al. | |
| 6,620,224 | B1 | 9/2003 | Sato | |
| 6,635,105 | B2 * | 10/2003 | Ahlborn | B03C 3/06 134/6 |
| 7,316,735 | B2 * | 1/2008 | Tomimatsu | B03C 3/41 55/DIG. 38 |
| 2008/0216660 | A1 * | 9/2008 | Mendel | B03C 3/08 96/88 |
| 2009/0107338 | A1 * | 4/2009 | Allan | B03C 3/16 96/84 |
| 2010/0269692 | A1 | 10/2010 | Gefter et al. | |
| 2012/0037001 | A1 | 2/2012 | Gefter et al. | |
| 2012/0198995 | A1 | 8/2012 | Gefter et al. | |
| 2017/0113229 | A1 * | 4/2017 | Griffiths | F24F 3/166 |

FOREIGN PATENT DOCUMENTS

| | | | |
|---|---|---|---|
| WO | 01 85348 | A2 | 11/2001 |
| WO | 2004 041412 | A1 | 5/2004 |
| WO | 2006 086886 | A1 | 8/2006 |
| WO | 2010 123579 | A1 | 10/2010 |

OTHER PUBLICATIONS

Keiichi Nashimoto, "Growth Behavior of Silicon Oxide on Wire Anode of Positive Corona Discharge", Japanese Journal of Applied Physics, vol. 27, No. 8, Aug. 1988, pp. 1381-1385.

Jean-Maxime Roux, et al., "Investigation of a New Electrostatic Sampler for Concentrating Biological and Non-Biological Aerosol Particles", Aerosol Science and Technology, vol. 47, No. 5, 2013, pp. 463-471.

International Search Report dated Oct. 16, 2014, in PCT/EP2014/069476 Filed Sep. 12, 2014.

French Search Report dated Jun. 27, 2014, in FR 1358858 Filed Sep. 13, 2013.

* cited by examiner

ELECTROSTATIC COLLECTOR

TECHNICAL DOMAIN

This invention relates to an electrostatic device for collecting particles in suspension in a gaseous medium, currently called an electrostatic collector or electrofilter. This invention relates more particularly to such a device comprising an interchangeable electrode.

STATE OF PRIOR ART

Detection and analysis of particles present in ambient air is a major concern at the present time, either for monitoring air quality, for protecting populations against airborne pathogenic agents (*legionnella*, influenza, etc.) or for security challenges (detection of biological attacks).

Electrostatic collectors or electrofilters, currently referred to as ESP ("Electrostatic Precipitator"), can collect particles in suspension in a gaseous medium, for example ambient air. They can thus be used to purify the gaseous medium and possibly analyse collected particles.

An electrostatic collector comprises two electrodes located close to each other. One of the two electrodes, currently referred to as the discharge electrode, is polarised. The other electrode, currently referred to as the counter-electrode or the collection electrode, is usually grounded.

A strong electric field is induced between the two electrodes under the effect of the potential difference applied between the two electrodes. The electric field ionises the gas volume located between the two electrodes, creating a duct or ring of ionised gas around the discharge electrode. This phenomenon is called a corona discharge.

The gas containing the particles to be separated forced to transit between the discharge electrode and the counter-electrode then passes through an ion flux and the particles to be separated are ionised in turn. Under the effect of electrostatic forces, the charged particles thus created are attracted by the counter-electrode on which they are collected.

Since the electric field required to generate the corona discharge phenomenon is very strong, from several thousand or several tens of thousands of volts per centimeter close to the discharge electrode, discharge electrodes usually have a very low radius of curvature. Discharge electrodes are usually in the form of tips or wires.

Electrostatic collectors have high efficiency, particularly for collecting submicronic particles. Nevertheless, their performances reduce during use due to a change in the surface area of the discharge electrode. The document by Roux et al., *<<investigation of a new electrostatic sampler for concentrating biological and non-biological aerosol particles>>, Aerosol Science and Technology*, vol. 47, No. 5, p. 463-471, 2013, discloses such a phenomenon.

The discharge electrode then has to be cleaned or replaced regularly.

The discharge electrode is usually brought to dangerous very high voltages, from several thousands to several tens of thousands of volts.

Furthermore, the positioning of the discharge electrode sometimes requires high precision. The discharge electrode also has to be held at a fixed position relative to the counter-electrode, regardless of the orientation of the electrostatic collector.

Therefore, the problem arises of being able to replace an electrode of an electrostatic collector by another electrode in complete safety.

Another problem that arises is to be able to position an electrode in an electrostatic collector with high precision, and to keep the electrode in its position regardless of the orientation of the electrostatic collector.

PRESENTATION OF THE INVENTION

This invention is aimed particularly at solving these problems.

This invention relates to an electrostatic collector comprising a collection chamber, delimited by a tubular wall oriented along a first axis, and a support for holding an electrode in position in the collection chamber and for removing an electrode from the collection chamber.

The support comprises a guide passing transversally through the collection chamber, the first and second ends of which are fixed to the wall, the guide comprising a through opening, the longitudinal axis of which is oriented along the first axis, configured to hold the electrode. The support also comprises a first attachment element, comprising at least one electrically conducting part that will extend at least partly in the guide, from the first end towards the opening, and a second attachment element comprising at least one electrically insulating part, that can move in translation in the guide from the second end towards the opening and from the opening towards the second end.

The second attachment element is capable of moving from a closed position in which the electrode is held in said opening, to an open position in which the electrode is released from said opening.

According to one embodiment of this invention, the first attachment element is designed to electrically connect the electrode to a polarisation source for voltage source).

According to one embodiment of this invention, the first attachment element can extend in the guide at least as far as the opening.

According to one embodiment of this invention, when the second attachment element is in the closed position, the electrode is held in position through the opening between the first and second attachment elements, and when the second attachment element is in the open position, the second attachment element is not in contact with the electrode.

The first and second attachment elements may be screws.

One advantage of an electrostatic collector of the type disclosed above lies in the fact that the electrode can be positioned with high precision in the collection chamber. The guide and the first and second attachment elements hold the discharge electrode in a fixed position in the collection chamber, and particularly relative to the tubular wall.

According to one embodiment of this invention, the first attachment element comprises a perforated moving part, comprising a cavity in which the electrode will be held, and a return means.

According to one embodiment of this invention, when the second attachment element is in the closed position, the electrode is held in the opening and in the cavity of the perforated part, the return means applying a surface of the perforated part in contact with the electrode, a first and a second surface of the guide bearing in contact with the electrode. When the second attachment element is in the open position, the return means is compressed, which moves the perforated moving part towards the first end such that the cavity of the perforated part communicates with the opening.

According to one embodiment of this invention, the first attachment element and the second attachment element are fixed to each other.

According to one embodiment of this invention, the support also comprises a pin that is fixed transversally to the guide and is arranged through the cavity of the perforated part.

The second attachment element may be a push button.

The first attachment element may be a screw.

The return means may be a spring.

One advantage of an electrostatic collector of the type described above lies in the fact that the electrode can be positioned in the collection chamber with high precision. The guide and the perforated part hold the discharge electrode in the collection chamber with a vertical orientation, due to three support zones.

The first attachment element may be made of stainless steel.

The second attachment element may be made of a thermoplastic polymer, for example a material chosen from among the group including nylon, polyvinylidene fluoride and polyetheretherketone.

The guide opening diameter may be between 0.2 mm and 2.5 or even 5 mm.

This invention also relates to the use of an electrostatic collector comprising a collection chamber, delimited by a tubular wall oriented along a first axis, and a support comprising a guide passing transversally through the collection chamber, the first and second ends of which are fixed to the wall, the guide comprising a through opening, the longitudinal axis of which is oriented along the first axis, configured to hold an electrode; a first attachment element comprising at least one electrically conducting part, that will extend at least partly in the guide, from the first end towards the opening; and a second attachment element comprising at least one electrically insulating part, that will move in translation in the guide from the second end towards the opening and from the opening towards the second end. An electrode is held in the collection chamber by moving the second attachment element from an open position to a closed position, to hold the electrode in said opening. An electrode is removed from the collection chamber by moving the second attachment element from a closed position to an open position, so as to release the electrode from said opening.

According to one embodiment of this invention, the electrostatic collector is positioned such that the first axis is vertical.

According to one embodiment of this invention, the first attachment element extends in the guide at least as far as the opening.

To hold an electrode in position in the collection chamber, the second attachment element is moved the second end of the guide, and the electrode is then positioned through said opening. The second attachment element is then moved towards the opening, such that the electrode is held in position between the first and the second attachment elements.

To remove an electrode is removed from the collection chamber, the second attachment element is moved towards the second end of the guide such that the second attachment element is not in contact with the electrode.

A first electrode held in position in the collection chamber is replaced by a second electrode by moving the second attachment element towards the second end of the guide such that the second attachment element is not in contact with the first electrode. The second electrode is then placed in said opening instead of the first electrode by pushing the first electrode outside said opening. The second attachment element is then moved towards said opening, such that the second electrode is held in place by the first and second attachment elements.

One advantage of an electrostatic collector of the type described above is that a user can handle an electrode in complete safety, with no risk due to the high voltages. An electrode may be installed in the electrostatic collector, removed from the electrostatic collector or replaced by another electrode in complete safety.

According to one embodiment of this invention, the first attachment element comprises a perforated moving part, comprising a cavity in which the electrode will be held in position, and a return means.

To hold an electrode in position in the collection chamber, the second attachment element is moved towards the opening so as to make the cavity communicate with the opening, and the electrode is then positioned inside the opening and inside the cavity. The second attachment element is then moved towards the second end of the guide, such that the electrode is in contact with a surface of the perforated part and with a first surface and a second surface of the guide, and is held in place between the perforated part and the guide.

To remove an electrode from the collection chamber, the second attachment element is moved towards the opening such that the cavity communicates with the opening.

To replace a first electrode held in position in the collection chamber by a second electrode, the second attachment element is moved towards the opening such that the cavity communicates with the opening. The second electrode is then positioned in the opening to replace the first electrode by pushing the first electrode outside said opening. The second attachment element is then moved towards the second end of the guide, such that the second electrode is in contact with a surface of the perforated part and with a first surface and a second surface of the guide, and is held in place between the perforated part and the guide.

One advantage of an electrostatic collector of the type described above lies in the fact that a user can handle an electrode in complete safety without any risk due to the high voltages. An electrode can be installed in the electrostatic collector, removed from the electrostatic collector or replaced by another electrode in complete safety.

According to one embodiment of this invention, the support also comprises a pin that is fixed transversally to the guide and is placed through the cavity of the perforated part. When the second attachment element moves from the closed position to the open position, the second attachment element bears in contact with a surface of the pin, which stops the translation movement of the second attachment element from the second end of the guide towards the opening.

BRIEF DESCRIPTION OF THE DRAWINGS

Other characteristics and advantages of the invention will become clearer after reading the following description with reference to the appended drawings, given solely for illustrative purposes and in no way limitative.

Identical, similar or equivalent parts of the various figures will be assigned the same numeric references to facilitate a comparison between figures.

The various parts shown on figures are not necessarily all at the same scale to make the figures more easily readable.

DETAILED DESCRIPTION OF PARTICULAR EMBODIMENTS

The following description uses the example of the collection of particles in suspension in air. Obviously, the invention is applicable to the collection of particles in suspension in any gas medium.

Figure 1B:
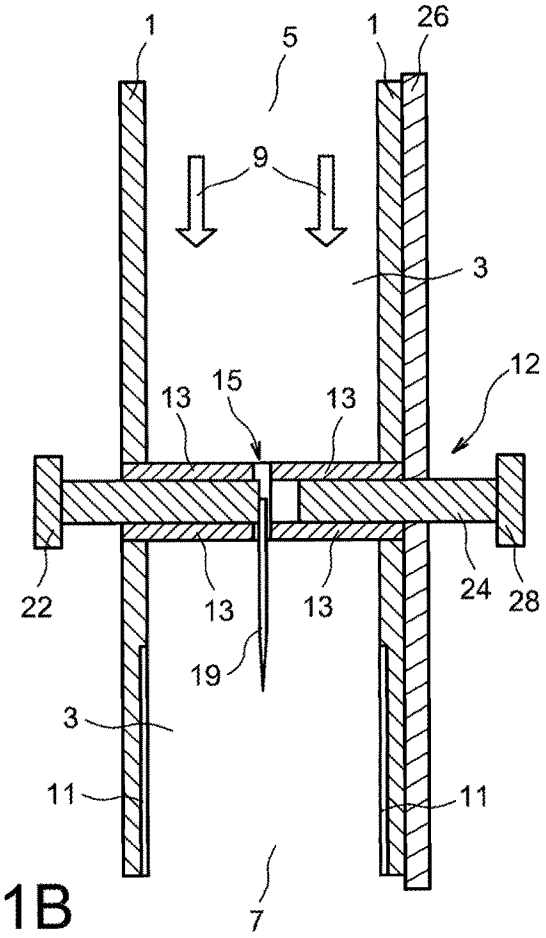
FIGS. 1A and 1B are sectional views diagrammatically showing an example embodiment of an electrostatic collector, when a discharge electrode is held in place in the collection chamber and when it is released from the collection chamber, respectively.
Figure 1A:
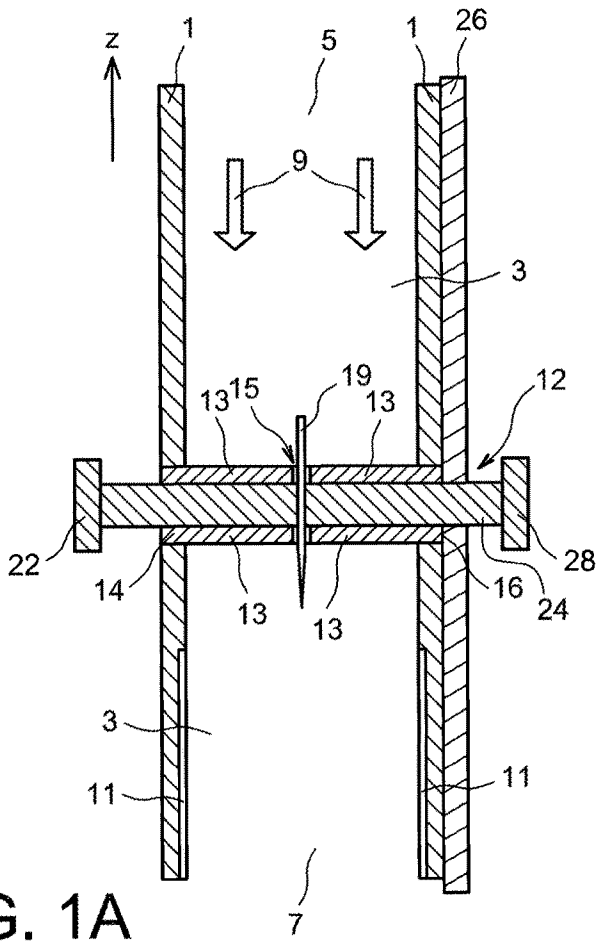
Figure 2:
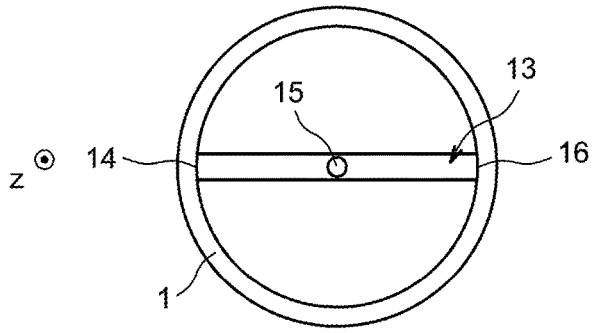
FIG. 2 is a top view corresponding to FIGS. 1A-1B.

FIGS. 1A and 1B are sectional views diagrammatically showing an electrostatic collector according to the invention, when a discharge electrode is held in place in the collection chamber and when it is removed from the collection chamber, respectively. FIG. 2 is a top view corresponding to FIGS. 1A and 1B, only some of the elements in FIGS. 1A and 1B being shown in FIG. 2.

A tubular wall 1 delimits a collection chamber 3. The longitudinal axis of the wall 1 is oriented along the z axis. The wall 1 may be a cylinder of revolution, as is shown in FIG. 2. The wall 1 is preferably made from an electrically insulating material. During operation, the electrostatic collector will be oriented such that the z axis is along the vertical direction or a direction tilted from the vertical. The wall 1 comprises an upstream end and a downstream end delimiting an inlet 5 and an outlet 7 of the collection chamber, respectively. The terms "upstream", "downstream", "inlet", and "outlet" are considered relative to the direction of the air flow in the electrostatic collector, symbolised by the arrows 9. Air flows from the upstream to downstream direction, from the inlet 5 to the outlet 7 of the electrostatic collector.

A collection electrode 11, for example cylindrical, is placed inside the collection chamber 3, in contact with the wall 1. As shown in FIGS. 1A and 1B, the collection electrode 11 extends for example along only a part of the wall 1. According to one alternative, the collection electrode 11 may cover the entire inner surface of the wall 1 of the collection chamber. Advantageously, in the case in which the collection electrode 11 does not cover the entire inner surface of the wall 1, the inside diameter of the collection electrode 11 is approximately equal to the inside diameter of the wall 1 to reduce discontinuities in the diameter of the collection chamber along the air flow path. The collection electrode 11 will form the particle collection surface. For example, it may be connected to the ground.

A guide 13, for example a tube, the two ends 14, 16 of which are fixed to the wall 1, passes transversally through the collection chamber. The longitudinal axis of the guide 13 is oriented perpendicular to the longitudinal axis (z axis) along which the tubular wall 1 extends.

The guide 13 is preferably made from an insulating material. The guide 13 comprises a through opening 15, for example cylindrical, the longitudinal axis of which is parallel to the z-axis. The opening 15 of the guide 13 is configured to hold a discharge electrode 19. The guide 13 may for example be placed in the collection chamber such that the discharge electrode 19 is located upstream from the collection electrode 11, as is shown in FIGS. 1A and 1B.

For example, the discharge electrode 19 may be in the form of a tip.

The discharge electrode 19 may also be a capillary tube. In this case, during use, the tip of the discharge electrode consists of a liquid drop present at the downstream end of the capillary tube. An example of an electrostatic collector comprising such a discharge electrode is disclosed in patent application FR 12 53945.

As an example, the length of the guide 13, corresponding to the inside diameter of the tubular wall 1 may be between 1 and 10 cm. The diameter of the opening 15 may for example be of the order of 0.2 mm to 2.5 or even 5 mm. The average diameter of the discharge electrode 19 may for example be between 100 μm and 5 mm.

Attachment elements 22 and 24 are designed to hold the discharge electrode 19 in position in the opening 15 of the guide 13.

A first attachment element 22, for example a screw, is designed to be placed at least partly inside the guide 13, extending from the first end 14 of the guide 13 at least as far as the opening 15. The first attachment element 22 may also extend partly outside the guide 13, on the side of the first end 14. A second attachment element 24, for example a screw, will be inserted in the guide 13 from the second end 16 of the guide.

The second attachment element 24 can be moved in translation from the second end 16 towards the opening 15 and from the opening 15 towards the second end 16. In other words, the second attachment element 24 can slide in the guide 13, between the opening 15 and the second end 16. The second attachment element 24 is preferably long enough such that when it is inserted in the guide 13 as far as the opening 15, a part projects outside the guide 13, through the second end 16, so that it is accessible to the user by a gripping means 28. The gripping means 28 is located in the part of the second attachment element 24 projecting from the guide 13.

The guide 13 and the attachment elements 22 and 24 form a support 12 that holds the discharge electrode 19 in position in the collection chamber. The support 12 can also release the discharge electrode 19 so that it can be removed from the collection chamber. The discharge electrode 19 may thus be cleaned or another discharge electrode may be held in place in the support 12 instead of the electrode 19. The second attachment element 24 can move from a closed position in which the electrode is held in place in the opening 15 of the guide 13, to an open position in which the electrode is released from the opening 15.

The first attachment element 22 will also electrically connect the discharge electrode 19 to a voltage source located outside the collection chamber, so as to polarise the discharge electrode. The first attachment element 22 comprises at least one electrically conducting part. The first attachment element 22 may for example be made from a metallic material, preferably stainless steel. It can be connected to a voltage source not shown. Since the discharge electrode will be polarised at voltages of several thousand to several tens of thousands of volts, the first attachment element 22 is protected, for example by an insulating casing or housing (not shown) so that the user cannot access this element directly.

The second attachment element 24 comprises an electrically insulating material and is accessible to the user. Thus, the second attachment element 24 acts as an electrical insulator between the discharge electrode 19 and the gripping means 28. The second attachment element 24 may be made of a thermoplastic polymer, for example nylon or polyvinylidene fluoride (usually designated by the acronym PVDF) or polyetheretherketone (usually designated by the acronym PEEK).

Possibly, a protection wall 26 at least partially covers the outer surface of the wall 1 of the collection chamber, on the side of the second end 16 of the guide 13 accessible to the user. The result is reinforced protection of the user against high voltages.

FIG. 1A shows the electrostatic collector when the second attachment element 24 is in the closed position. An electrode 19 is positioned vertically inside the opening 15 of the guide 13, and is in contact with the attachment elements 22 and 24. Each attachment element 22, 24 bears on a portion of the periphery of the electrode, the two bearing forces thus holding the electrode in position, trapped between the attachment elements 22 and 24, in the support 12.

FIG. 1B shows the electrostatic collector when the second attachment element 24 is in the open position, which makes it possible to release the discharge electrode 19 and to remove it from the collection chamber, for example to clean it or to replace the electrode. The second attachment element 24 is no longer in contact with the electrode 19 that drops under the effect of gravity (FIG. 1B shows an intermediate position).

One advantage of an electrostatic collector of the type described above lies in the fact that the discharge electrode may be positioned with high precision in the collection chamber. The guide 13 and the attachment elements 22, 24 hold the discharge electrode in position along a vertical orientation in the collection chamber.

A method of installing a discharge electrode in an electrostatic collector of the type shown in FIGS. 1A-1B and removing it is described below.

Placement of a Discharge Electrode in the Collection Chamber.

The second attachment element 24 is in the open position.

A discharge electrode 19, held in place by a tool, particularly a non-conducting tool, for example a clamp, is inserted into the collection chamber 3 through the inlet 5.

The electrode 19, still held in place by the tool, is put into position through the opening 15 of the guide 13. The second attachment element 24 is then moved from the open position to the closed position. The second attachment element 24 is moved in the guide 13 from the second end 16 as far as the opening 15, such that the electrode 19 is in contact with the attachment elements 22 and 24. The second attachment element 24 is moved towards the electrode 19 until the electrode is firmly held in place between the attachment elements 22 and 24 to remain in position when the tool is removed. The tool is then removed from the collection chamber, the discharge electrode 19 being held in place between the attachment elements 22 and 24.

Removal of a Discharge Electrode from the Collection Chamber.

To remove the discharge electrode 19 from the collection chamber, the second attachment element 24 is moved from the closed position to the open position. The second attachment element 24 is moved in the guide 13, from the opening 15 towards the second end 16 so that it is no longer in contact with the electrode 19. The electrode 19 drops under the effect of gravity.

If the diameter of the opening 15 of the guide 13 is similar to the average diameter of the electrode 19, the electrode 19 might not drop under the effect of gravity. In this case, the embodiment described below of a method for removing a discharge electrode from an electrostatic collector as shown in FIGS. 1A and 1B will be preferred. Such a method can be used to remove a discharge electrode from an electrostatic collector and replace it by another discharge electrode.

Let us assume that a discharge electrode 19 is installed in the collection chamber, held in place by attachment elements 22 and 24 as shown in FIG. 1A.

Another discharge electrode called the replacement electrode, held in place by a non-conducting tool, for example a clamp, is inserted through the inlet 5 into the collection chamber 3.

The attachment means 24 is moved in the guide 13 towards the second end 16 so that it is no longer in contact with the electrode 19. The replacement electrode, held in place by the tool, is used to push the electrode 19 outside its housing. It is installed to replace electrode 19, in the opening 15 of the guide 13. The second attachment element 24 is then moved towards the replacement electrode such that it is held in place by attachment elements 22 and 24. The tool can then be removed from the collection chamber. The electrode 19, once freed, drops under the effect of gravity, and is removed from the collection chamber through the outlet 7.

One advantage of an electrostatic collector of the type described above lies in the fact that a discharge electrode may be handled by a user in complete safety, without any risk of high voltages. A discharge electrode may be installed in the electrostatic collector, removed from the electrostatic collector or replaced by another discharge electrode in complete safety.

Figure 3B:
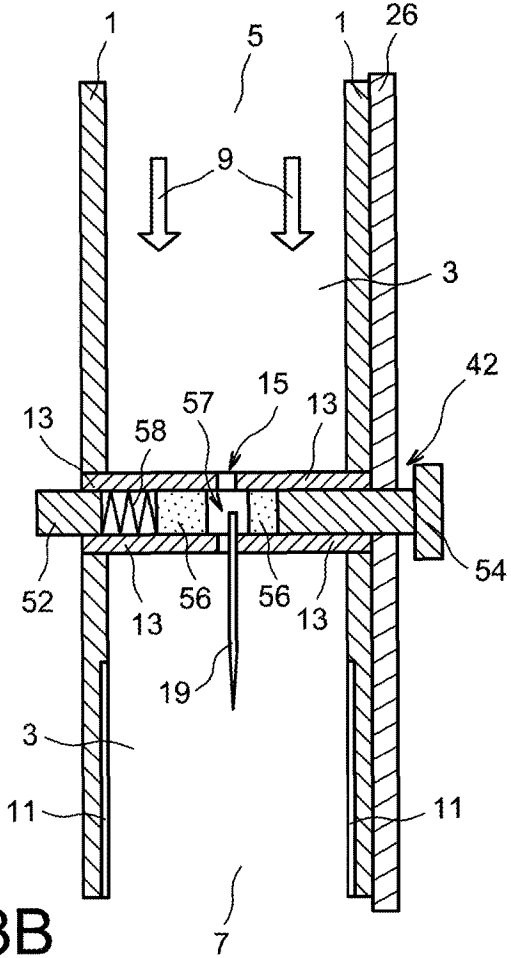
FIGS. 3A and 3B are sectional views diagrammatically showing another example embodiment of an electrostatic collector, when a discharge electrode is held in place in the collection chamber and when it is released from the collection chamber, respectively.
Figure 3A:
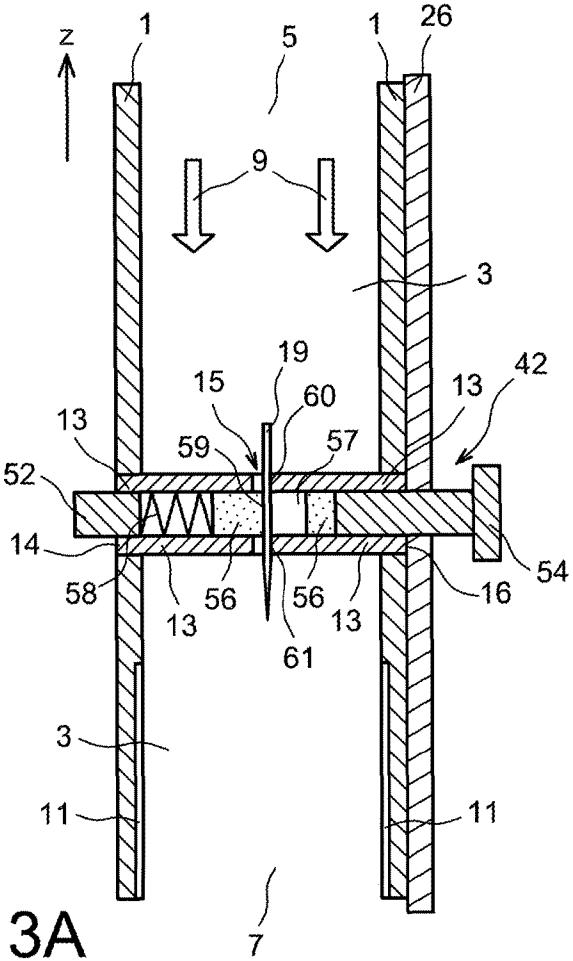

FIGS. 3A and 3B are sectional views diagrammatically showing another embodiment of an electrostatic collector according to the invention, when a discharge electrode is held in place in the collection chamber and when a discharge electrode is removed from the collection chamber, respectively. Elements common with the elements in the electrostatic collector in FIGS. 1A-1B have the same references and will not be described again in the following.

As in the embodiment shown in FIGS. 1A-1B, a guide 13 comprises a through opening 15 configured to hold a discharge electrode 19.

A first attachment element 52, for example a screw, is positioned at least partly inside the guide 13 and extends from the first end 14 towards the second end 16 of the guide 13. The first attachment element 52 may also extend partly outside the guide 13, on the side of the first end 14.

A second attachment element 54, for example a pushbutton, will be inserted in the guide 13, from the second end 16 of the guide towards the opening 15. The second attachment element 54 can move in translation in the guide 13, from the second end 16 towards the opening 15 and from the opening 15 towards the second end 16.

The first attachment element 52 comprises a perforated moving part 56 and a return means 58, for example a spring. The perforated moving part 56 is placed in the guide 13 between the return means 58 and the second attachment element 54.

The guide 13 and the attachment elements 52 and 54 form a support 42 that will hold the discharge electrode 19 in position in the collection chamber. The support 42 also releases the discharge electrode 19 so that it can be removed from the collection chamber, for example to be cleaned or to be replaced by another electrode. The second attachment element 54 can move from a closed position in which the electrode is held in place in the opening 15 of the guide 13, to an open position in which the electrode is released from the opening 15.

The first attachment element 52 is used to electrically connect the discharge electrode 19 to a polarisation source. The first attachment element 52 comprises an electrically conducting material, for example a metallic material, preferably stainless steel, so as to create an electrical contact between the discharge electrode 19 and a voltage source, not shown. As in the embodiment in FIGS. 1A-1B, the first attachment element 52 is not directly accessible to the user. It may be for example surrounded by a casing.

In the same way as in the previous embodiment, the second attachment element 54 comprises an electrically insulating material and is accessible to the user. The second attachment element 54 may be made of a thermoplastic polymer, for example nylon or PVDF or PEEK.

Figure 4A:
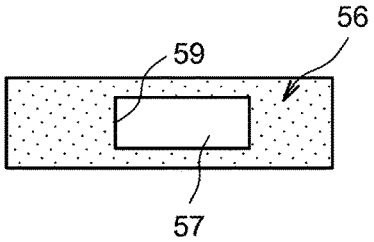
FIGS. 4A and 4B are top views diagrammatically showing two variant embodiments of a part of the electrostatic collector in FIGS. 3A and 3B.

FIG. 4A is a top view diagrammatically showing an example embodiment of the perforated part 56. The perforated part 56 comprises a cavity 57 through which the discharge electrode 19 can extend, the electrode bearing in contact with the inner surface 59 of the perforated part 56, this inner surface advantageously extending perpendicular to the longitudinal axis of the guide 13. The cavity 57 may be an oblong hole, preferably a slit.

Figure 4B:
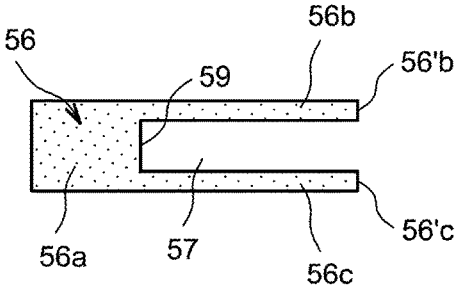

FIG. 4B is a top view diagrammatically showing a variant embodiment of the perforated part 56, that is easier to machine. The slit 57 is made in the part 56 such that it forms an opening leading to the outside of the part 56. The part 56 in this case comprises a main portion 56*a* and two arms 56*b* and 56*c* that extend from the main portion parallel to the longitudinal axis of the guide 13 when the part 56 is inserted into the guide 13. The ends 56'*b* and 56'*c* of the arms 56*b* and 56*c* will bear in contact with the end of the second attachment element 54 that is facing the opening 15.

As an example, the length of the guide 13 corresponding to the inside diameter of the tubular wall 1, may be between approximately 1 cm and approximately 10 cm. The diameter of the opening 15 may for example be of the order of 0.2 mm to 3 or even 5 mm. The average diameter of the discharge electrode 19 may for example be between approximately 100 μm and approximately 5 mm. The width of the cavity 57 of the part 56 may for example be between approximately 0.2 mm and approximately 3 or even 5 mm.

FIG. 3A shows the electrostatic collector when the pushbutton 54 is left free (closed position). An electrode 19 is installed vertically inside the opening 15 of the guide 13 and passes through the cavity 57 of the part 56. Due to the action of the spring 58, the inner surface 59 of the cavity 57 bears in contact with the electrode 19, which then bears in contact with the inner surface of the opening 15 of the guide 13. It will then be understood that the electrode is held in contact with the first attachment element 52 (and more precisely in contact with the inner surface 59 of the perforated part 56) and in contact with the inner surface of the opening 15 of the guide 13. It should be noted that the inner surface of the opening 15 comprises an upstream surface 60 and a downstream surface 61, on each side of the longitudinal axis along which the guide 13 extends. The electrode 19 is held in place in the support 42, between the perforated part 56 and the guide 13, by means of the three bearing zones 59, 60 and 61.

FIG. 3B shows the electrostatic collector when the pushbutton 54 is pressed in (open position), which releases the discharge electrode 19 so that it can be removed from the collection chamber. The pushbutton 54 applies pressure on the perforated moving part 56. The spring 58 is compressed and the perforated moving part 56 moves towards the first end 14. The perforated part 56 and the spring 58 are chosen such that when the pushbutton 54 is pressed in, the cavity 57 of the part 56 communicates with the opening 15 of the guide 13. The electrode 19 that is no longer held in place between the part 56 and the guide 13, drops under the effect of gravity.

According to one variant of the electrostatic collector described with reference to FIGS. 3A and 3B, the first attachment element 52 and the second attachment element 54 are fixed to each other.

One advantage of an electrostatic collector of the type described with reference to FIGS. 3A and 3B lies in the fact that the discharge electrode may be positioned very precisely in the collection chamber. The guide 13 and the perforated part 56 can hold the discharge electrode in position along a vertical orientation in the collection chamber, by means of three bearing zones.

A method of installing a discharge electrode in an electrostatic collector of the type shown in FIGS. 3A-3B and removing it is described below.

Installation of a Discharge Electrode in the Collection Chamber.

The pushbutton 54 is pressed in so that the cavity 57 of the part 56 can communicate with the opening 15 of the guide 13.

A discharge electrode 19, held in place by a non-conducting tool, for example a clamp, is inserted in the collection chamber 3 through the inlet 5.

The electrode 19, still held in place by the tool, is positioned inside the opening 15 of the guide 13 and passes through the cavity 57 of the part 56. The electrode 19 is held in position in the support 42 by leaving the pushbutton 54 free such that the part 56 applies pressure on the electrode 19 that is then pushed in contact with the guide 13. The electrode 19 is held in place in the support 42, between the perforated part 56 and the guide 13.

The tool is then removed from the collection chamber, the discharge electrode 19 being held in place between the perforated part 56 and the guide 13 by the three bearing zones 59, 60 and 61.

Removal of a Discharge Electrode from the Collection Chamber.

To remove the discharge electrode 19 from the collection chamber the pushbutton 54 is pressed in. The spring 58 is compressed, which moves the perforated moving part 56 towards the first end 14 so that the cavity 57 of the part 56 communicates with the opening 15 of the guide 13. The electrode 19 is no longer held in place between the perforated part 56 and the guide 13 because the bearing zone corresponding to the surface 59 of the part 56 has disappeared. The electrode 19 drops under the effect of gravity.

If the diameter (or width) of the opening 15 of the guide 13 and/or the cavity 57 of the perforated part 56 is similar to the average diameter of the electrode 19, the electrode 19 might not drop under the effect of gravity. In this case, as in the embodiment in FIGS. 1A and 1B, another discharge electrode will be used, held in place by a non-conducting tool, to push the electrode 19 outside its housing. The discharge electrode can then be removed from the electrostatic collector and replaced by another electrode at the same time.

One advantage of an electrostatic collector of the type described with reference to FIGS. 3A and 3B lies in the fact that a user can handle a discharge electrode in complete safety, without any risk due to high voltages. A discharge electrode can be installed in the electrostatic collector, removed from the electrostatic collector or replaced by another discharge electrode in complete safety.

Figure 6A:
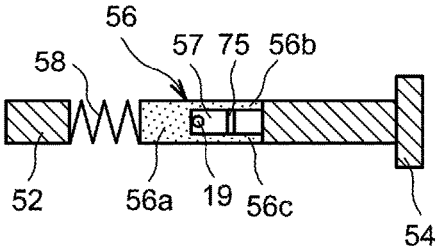
FIGS. 6A and 6B are top views corresponding to FIGS. 5A and 5B.
Figure 6B:
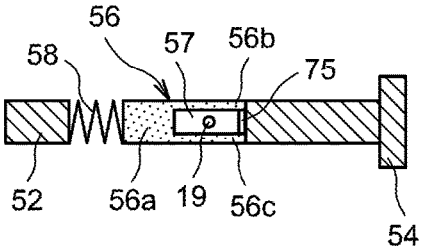
Figure 5B:
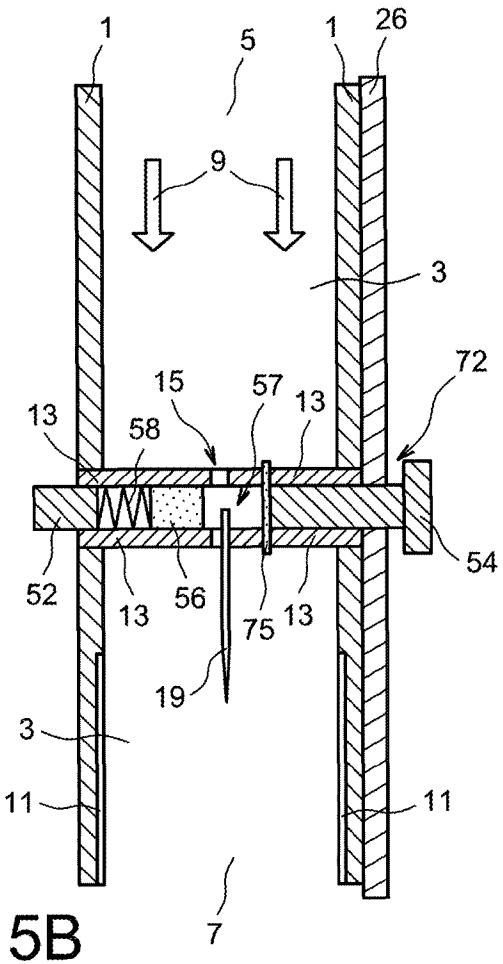
FIGS. 5A and 5B are sectional views diagrammatically showing a variant embodiment of the electrostatic collector in FIGS. 3A and 3B.
Figure 5A:
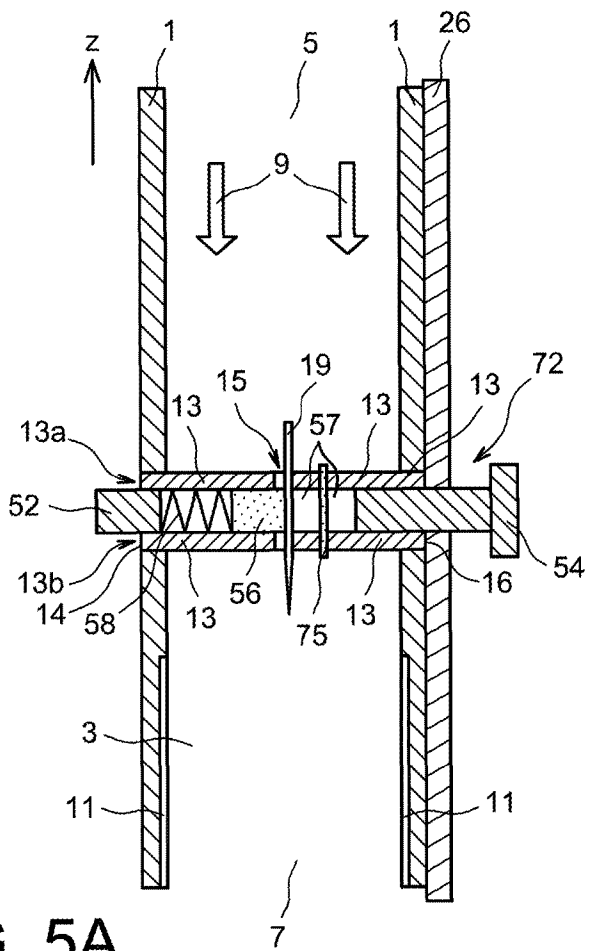

FIGS. 5A and 5B are sectional views diagrammatically showing a variant embodiment of the electrostatic collector in FIGS. 3A-3B, when a discharge electrode is held in place in the collection chamber and when it is removed from the collection chamber, respectively. Elements common to those in the electrostatic collector in FIGS. 3A-3B have the same references and will not be described again below. FIGS. 6A and 6B are top views corresponding to FIGS. 5A and 5B respectively, only some of the elements in FIGS. 5A and 5B being shown in FIGS. 6A and 6B.

A support 72, comprising a guide 13 and attachment elements 52 and 54, holds a discharge electrode 19 in the collection chamber. The support 72 can also release the discharge electrode 19 so that it can be removed from the collection chamber, for example to be cleaned or to be replaced by another electrode.

The support 72 also comprises a pin 75 that is fixed to the upstream part 13*a* and the downstream part 13*b* of the guide 13 and passes transversally through the guide 13. The pin 75 is placed between the second end 16 of the guide 13 and the opening 15, through the cavity 57 of the perforated part 56.

The pin 75 will form a translation stop for the pushbutton 54 when it is moved from the second end 16 towards the opening 15 of the guide 13.

FIGS. 5A and 6A show the electrostatic collector when the pushbutton 54 is left free (closed position), a discharge electrode 19 being held in place in the support 72. The pin 75 is at a distance from the discharge electrode 19 and at a distance from the pushbutton 54.

FIGS. 5B and 6B show the electrostatic collector when the pushbutton 54 is pressed in (open position), which releases the discharge electrode 19 so that it can be removed from the collection chamber. The pushbutton 54 is in contact with the pin 75.

When changing from the closed position (FIGS. 5A and 6A) to the open position (FIGS. 5B and 6B), in other words when the pushbutton is pressed in to release the discharge electrode 19, the pushbutton 54 bears in contact with a surface of the pin 75 which stops the translation movement of the pushbutton 54 from the second end 16 of the guide towards the opening 15.

Furthermore, the pin 75 also forms a rotation stop of the perforated part 56 when changing from the closed position to the open position and vice versa. The result is precise positioning of the discharge electrode 19 in the opening 15 of the guide 13 in the closed position.

The invention claimed is:

1. An electrostatic collector comprising a collection chamber, delimited by a tubular wall oriented along a first axis (z), and a support for holding an electrode in position in the collection chamber and for removing the electrode from the collection chamber, the support comprising:

a guide, passing transversally through the collection chamber, first and second ends of which are fixed to the wall, the guide comprising a through opening, the longitudinal axis of which is oriented along the first axis, configured to hold the electrode;

a first screw, comprising at least one electrically conducting part that will extend at least partly in the guide, from the first end towards the opening; and a second screw, comprising at least one electrically insulating part, that can move in translation in the guide from the second end towards the opening and from the opening towards the second end;

the second screw being capable of moving from a closed position in which the electrode is held in said opening, to an open position in which the electrode is released from said opening.

2. The electrostatic collector according to claim 1, wherein the first screw is designed to electrically connect the electrode to a polarization source.

3. The electrostatic collector according to claim 1, wherein the first screw can extend in the guide at least as far as the opening.

4. The electrostatic collector according to claim 3, wherein:

when the second screw is in the closed position, the electrode is held in position through the opening, between the first and second screws, and when the second screw is in the open position, the second screw is not in contact with the electrode.

5. An electrostatic collector comprising a collection chamber, delimited by a tubular wall oriented along a first axis (z), and a support for holding an electrode in position in the collection chamber and for removing the electrode from the collection chamber, the support comprising:

a guide, passing transversally through the collection chamber, first and second ends of which are fixed to the wall, the guide comprising a through opening, the longitudinal axis of which is oriented along the first axis, configured to hold the electrode;

a screw, comprising at least one electrically conducting part that will extend at least partly in the guide, from the first end towards the opening; and a pushbutton, comprising at least one electrically insulating part, that can move in translation in the guide from the second end towards the opening and from the opening towards the second end;

the pushbutton being capable of moving from a closed position in which the electrode is held in said opening, to an open position in which the electrode is released from said opening, wherein the screw comprises a perforated moving part, comprising a cavity in which the electrode will be held, and a spring.

6. The electrostatic collector according to claim 5, wherein:

when the pushbutton is in the closed position, the electrode is held in place in the opening and in the cavity of the perforated moving part, the spring applying a surface of the perforated moving part in contact with the electrode, a first and a second surface of the guide bearing in contact with the electrode, and when the pushbutton is in the open position, the spring is compressed, which moves the perforated moving part towards the first end such that the cavity of the perforated moving part communicates with the opening.

7. The electrostatic collector according to claim 5, wherein the screw and the pushbutton are fixed to each other.

8. The electrostatic collector according to claim 5, wherein the support also comprises a pin that is fixed transversally to the guide and is arranged through the cavity of the perforated moving part.

9. The electrostatic collector according to claim 1, wherein the first screw is made of stainless steel.

10. The electrostatic collector according to claim 1, wherein the second screw is made of a thermoplastic polymer.

11. The electrostatic collector according to claim 10, wherein the second screw is made of a material chosen from among the group including nylon, polyvinylidene fluoride and polyetheretherketone.

12. The electrostatic collector according to claim 1, wherein a diameter of the opening of the guide is between 0.2 mm and 2.5 mm.

13. An electrostatic collector comprising a collection chamber, delimited by a tubular wall oriented along a first axis (z), and a support for holding an electrode in position in the collection chamber and for removing the electrode from the collection chamber, the support comprising:

a guide, passing transversally through the collection chamber, first and second ends of which are fixed to the wall, the guide comprising a through opening, the longitudinal axis of which is oriented along the first axis, configured to hold the electrode;

a first attachment element, comprising at least one electrically conducting part that will extend at least partly in the guide, from the first end towards the opening; and a second attachment element, comprising at least one electrically insulating part, that can move in translation in the guide from the second end towards the opening and from the opening towards the second end;

the second attachment element being capable of moving from a closed position in which the electrode is held in said opening, to an open position in which the electrode is released from said opening.

* * * * *